US008349106B2

(12) United States Patent
Miyamoto et al.

(10) Patent No.: US 8,349,106 B2
(45) Date of Patent: Jan. 8, 2013

(54) ADHESIVE TAPE JOINING METHOD AND ADHESIVE TAPE JOINING APPARATUS

(75) Inventors: Saburo Miyamoto, Kameyama (JP); Yukitoshi Hase, Kameyama (JP); Masayuki Yamamoto, Ibaraki (JP)

(73) Assignee: Nitto Denko Corporation, Osaka (JP)

( * ) Notice: Subject to any disclaimer, the term of this patent is extended or adjusted under 35 U.S.C. 154(b) by 81 days.

(21) Appl. No.: 12/848,290

(22) Filed: Aug. 2, 2010

(65) Prior Publication Data

US 2011/0048609 A1 Mar. 3, 2011

(30) Foreign Application Priority Data

Aug. 31, 2009 (JP) ..... 2009-200315

(51) Int. Cl.
*B32B 41/00* (2006.01)

(52) U.S. Cl. ..... 156/64; 156/267; 156/269; 156/270; 156/719

(58) Field of Classification Search ..... 156/64, 156/267, 269, 270, 719
See application file for complete search history.

(56) References Cited

U.S. PATENT DOCUMENTS 8,002,010 B2 * 8/2011 Kitada et al. ..... 156/511
2007/0095451 A1 * 5/2007 Kramp ..... 156/64

FOREIGN PATENT DOCUMENTS

WO WO 2009084370 A1 * 7/2009

OTHER PUBLICATIONS

"Handbook of Adhesion, Third Edition", Japan Adhesive Tape Manufacturers Association, 2005, pp. 527-533.

* cited by examiner

*Primary Examiner* — George Koch
(74) *Attorney, Agent, or Firm* — Cheng Law Group, PLLC

(57) ABSTRACT

A joint detector detects a joint in an adhesive tape supplied from a tape supply section, and a computing unit determines a suitable cutting position of the adhesive tape for removing the joint in accordance with the detected results. A controller controls each mechanism to operate so as to satisfy the determined results by the computing unit. Thereafter, the adhesive tape including the joint is cut and removed.

5 Claims, 11 Drawing Sheets

ADHESIVE TAPE JOINING METHOD AND ADHESIVE TAPE JOINING APPARATUS

BACKGROUND OF THE INVENTION

1. Field of the Invention

This invention relates to adhesive tape joining method and apparatus for joining an adhesive tape to building materials including a large panel and a long object such as a strut and a reinforcing member.

2. Description of the Related Art

Recently adhesive tapes have been often used instead of conventional adhesives containing organic agents upon joining of the reinforcing member to the panel or building materials to each other. Moreover, adhesive tapes have been used for protecting a surface of the panel as a building material.

These building materials tend to larger in size for improved efficiency in assembling the materials. Consequently, in order to improve efficiency in joining the adhesive tape as many long or large building materials are to be used, an adhesive tape having a long length is used in which adhesive tapes of a predetermined length are joined to one another. In other words, a period of time to stop a joining apparatus required for exchanges of the adhesive tape tends to be reduced. See "Handbook of Adhesion", the third edition published in Oct. 1, 2005 by Japan Adhesive Tape Manufactures Association, 527-533.

In use of the adhesive tape in which adhesive tapes of a predetermined length are joined to one another, however, a following problem may arise. That is, where a joint is inserted into a joining portion of the building materials, the building materials have difference thickness due to the joint, and thus float may be occur on the joint. As a result, poor joining may arise.

Moreover, although an adhesive tape is used for protection of a panel, unnecessary pressure is to be applied to the joint portion having a large thickness when the panel is stacked for accommodation and handling, for example, thereby leading to bending of the panel inwardly or cracks in the panel.

SUMMARY OF THE INVENTION

This invention has one object to connect a joint that has a uniform to an adherend a portion of a long adhesive tape except.

Additional features of the invention will be set forth in the description which follows, and in part will be apparent from the description, or may be learned by practice of the invention.

This invention discloses a method of joining an adhesive tape to an adherend, including the steps of detecting a joint in the adhesive tape during supplying to the adherend the adhesive tape of a long length in which adhesive tapes of a predetermined length are connected to one another, removing the joint in accordance with detected results in the detecting step, and joining the adhesive tape with the joint removed therefrom to the adherend.

In the method of joining the adhesive tape according to this disclosure, the joint is detected from the adhesive tape to be supplied, and then removed according to the detected results.

The adhesive tape having the joint is never joined to the adherend. Consequently, there may be suppressed poor joining of the adherend due to the joint or damages in the adherend.

The detection step in this method preferably includes detecting a length of the joint, determining an allowable length of the adhesive tape capable of being joined from a joining portion to the joint in accordance with the length of the joint, a length of a transportation path determined in advance corresponding to a distance from a detecting position to a tape joining position of the adhesive tape, and a unit length of the adhesive tape joined to the adherend, and determining a removal length including the joint backward from the allowable length, the joining step in this method preferably including joining the adhesive tape except the removal portion of the adhesive tape including the joint to the adherend in accordance with the detected results obtained in the detecting step.

With this embodiment, the above method can be suitably performed.

Moreover, the joining step may include joining the adhesive tape to the adherend after pulling out the removal portion of the adhesive tape at the joining position and cutting to remove thereof. The joining step may also include joining the adhesive tape to the adherend after pulling out the removal portion of the adhesive tape at the joining position and winding to collect thereof.

According to the foregoing embodiments, removing of the removal portion in the adhesive tape including the joint may be ensured.

This invention also discloses an apparatus for joining an adhesive tape to an adherend. The apparatus includes a holding mechanism, a tape supply mechanism, a detector, a tape joining mechanism, a tape cutting mechanism, a computing unit, a tape pulling mechanism, a controller, and a tape collecting section. The holding mechanism holds an adherend. The tape supply mechanism supplies the adhesive tape of a long length that is formed of adhesive tapes of a predetermined length connected to one another to a joining portion of the adherend. The detector detects the joint in the adhesive tape to be supplied. The tape joining mechanism joins the adhesive tape to the adherend. The tape cutting mechanism cuts the adhesive tape. The computing unit detects a length of the joint, determines an allowable length of the adhesive tape from a joining portion to the joint in accordance with the length of the joint, a length of a transportation path determined in advance corresponding to a distance from a detecting position to a tape joining position of the adhesive tape, and a unit length of the adhesive tape joined to the adherend, and determines a removal length including the joint backward from the allowable length. The tape pulling mechanism holds and pulls out a removal portion of the adhesive tape including the joint that is determined by the computing unite. The controller controls pulling of the removal portion in the adhesive tape including the joint at a tape joining portion in accordance with computed results by the computing unit, and joining the allowable length of the adhesive tape to the adherend with the tape joining mechanism after cutting the removal portion in the adhesive tape with the tape cutting mechanism. The tape collecting section collects the cut-out removal portion in the adhesive tape including the joint.

With this configuration, the foregoing method may be suitably performed.

The tape pulling mechanism may include a holder. The holder suction-holds a non-adhesive surface of the adhesive tape in the forward end side with at least one of a pair of holding surfaces thereof under an open state, unites both of the holding surfaces to fold back the adhesive surface of the adhesive tape for joining thereof, and holds the forward end of the adhesive tape. The holder may also be swingable. Moreover, the tape pulling mechanism may be formed of a winding mechanism to wind up the forward end of the adhesive tape while joining thereto.

When the tape pulling mechanism is formed of the winding mechanism, the removal portion of the adhesive tape may be wound and collected.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DESCRIPTION OF THE PREFERRED EMBODIMENTS

Figure 1:
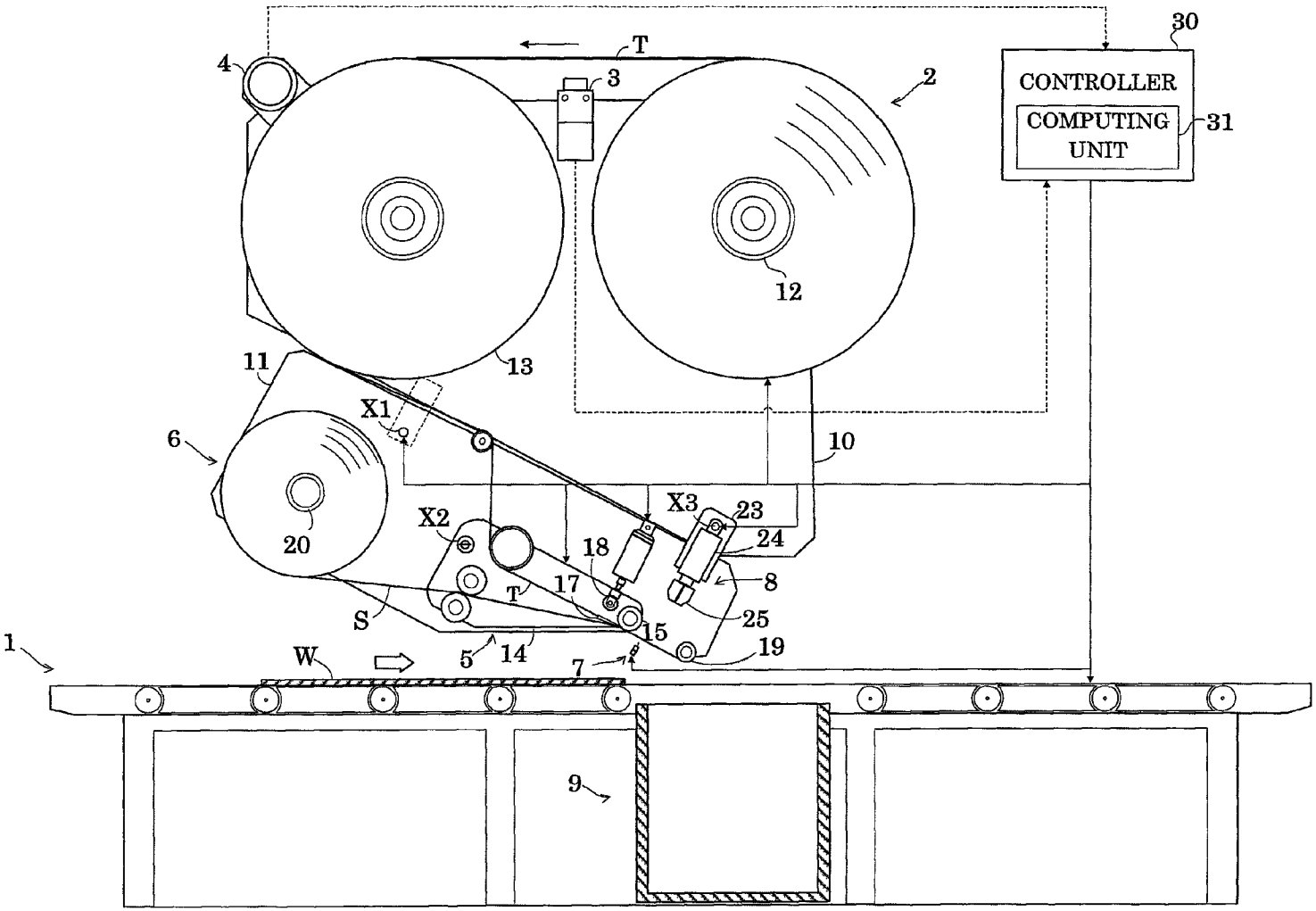
FIG. 1 is a front view of an adhesive tape joining apparatus according to Embodiment 1.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

One embodiment of this invention will be described hereunder with reference to the drawings.

In the exemplary embodiments, method and apparatus will be described for joining an adhesive tape to a large and thin building panel while forming tabs on opposite ends of the adhesive tape. However, the method and apparatus are not limited to this exemplary embodiment. For instance, the method and apparatus are also applicable to various large or long adherends such as building materials including a strut and a reinforcing member rather than a building panel. The method and apparatus are also applicable to an aspect to join the adhesive tape with no tab formed therein.

Figure 19:
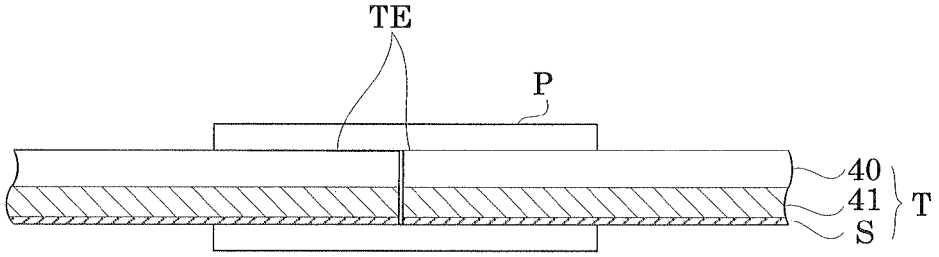
FIG. 19 is a side view showing the joint of the adhesive tape.

An adhesive tape T used in the exemplary embodiments is as shown in FIG. 19. That is, the adhesive tape T of a long length has a joint P. The joint P is made by connecting ends TE of the adhesive tapes T having a thickness of 100 to 200 m to one another via a same joining material as that of the adhesive tape or a different joining material from the adhesive tape T. Here, the adhesive tape T has an adhesive layer 41 and a separator S on one surface of a base material 40 thereof.

Embodiment 1

FIG. 1 is a front view of an adhesive tape joining apparatus.

The adhesive tape joining apparatus has a panel transport mechanism 1, a tape supply mechanism 2, a joint detector 3, a detector 4, a tape joining mechanism 5, a separator collection section 6, a tape cutting mechanism 7, a tape pulling mechanism 8, and a tape collecting section 9. The panel transport mechanism 1 mounts and transports a building panel W as adherend on a transportation path. The tape supply mechanism 2 supplies an adhesive tape T to the building panel W on the transportation path. The joint detector 3 detects a joint P in the supplied adhesive tape T. The detector 4 detects a feeding length of the adhesive tape T. The tape joining mechanism 5 joins the adhesive tape T to the building panel W on the transportation path. The separator collecting section 6 separates and collects the separator S from the adhesive tape T. The tape cutting mechanism 7 cuts the adhesive tape T by a predetermined length. The tape pulling mechanism 8 pulls out the adhesive tape T by a predetermined length including the joint P. The tape collecting section 9 collects the cut-out adhesive tape T containing joint P. Here, the tape joining apparatus has a wall 10 on the back thereof that is placed vertically. The tape supply mechanism 2, the joint detector 3, the detector 4, the tape pulling mechanism 8, and a turn roller 13 that is to be mentioned later are arranged on the wall 10. The tape joining mechanism 5 and the separator collecting section 6 are pivotally supported to a connector on the wall 10, and placed on a bracket 11 pivotable about an axis X1. Hereinafter, description will be given to detailed configurations of the respective components and mechanisms.

The panel transport mechanism 1 is formed of a roller conveyor that suction-holds and transports a rear face of the building panel W.

The tape supply mechanism 2 has the following configuration. That is, the adhesive tape T provided with the separator S is fed out from a supply bobbin 12, and then is wound up by the turn roller 13 to be guided to the tape joining mechanism 5.

Here, the supply bobbin 12 is applied with appropriate resistance against its rotation in order to prevent the adhesive tape T from being fed out excessively.

The turn roller 13 controls a feeding length of the adhesive tape T in accordance with a unit length of the tape joining portion in an adherend such as the building panel W. For instance, a length of the adhesive tape from the joint detector 3 to a joining start position may be set so as to be integral multiples of the unit length of the tape joining portion. The diameter of the turn roller 13 is properly variable depending on tape joining conditions, e.g., an adherend.

The joint detector 3 just needs to detect the joint P in the adhesive tape T. For instance, the joint detector 3 may be any one of a contact micro switch, non-contact reflective sensor, or optical camera. Here, in the exemplary embodiments, a reflective sensor will be described by way of example.

The joint detector 3 detects the joint P. Simultaneously, the detector 4 detects the feeding length of the adhesive tape from the detecting position to the joining start position. Here, the detector 4 may be any one of contact or non-contact type. Exemplary Embodiment 1 adopts a rotary encoder.

The tape joining mechanism 5 has a first joining roller 15, an edge member 17, a pressure roller 18, and a second joining roller 19. The first joining roller 15 is pivotally supported at a forward end of a bracket 14 so as to freely rotate. The bracket 14 is pivotally supported by the bracket 11 and pivotable about an axis X2. The edge member 17 folds back and reverses the separator S arranged upstream of the first joining roller 15, and guides the separator S to the separator collecting section 6 via a hold roller. The pressure roller 18 holds the adhesive tape T with the edge member 17. The second joining roller 19 is pivotally supported at a lower end of the bracket 11 so as to freely rotate.

The pressure roller 18 is formed so as to move vertically by an actuator, such as a cylinder.

The separator collecting section 6 has the following configuration. That is, a collection bobbin 20 is driven to rotate in a winding direction in order to wind up the separator S separated from the adhesive tape T.

Figure 8:
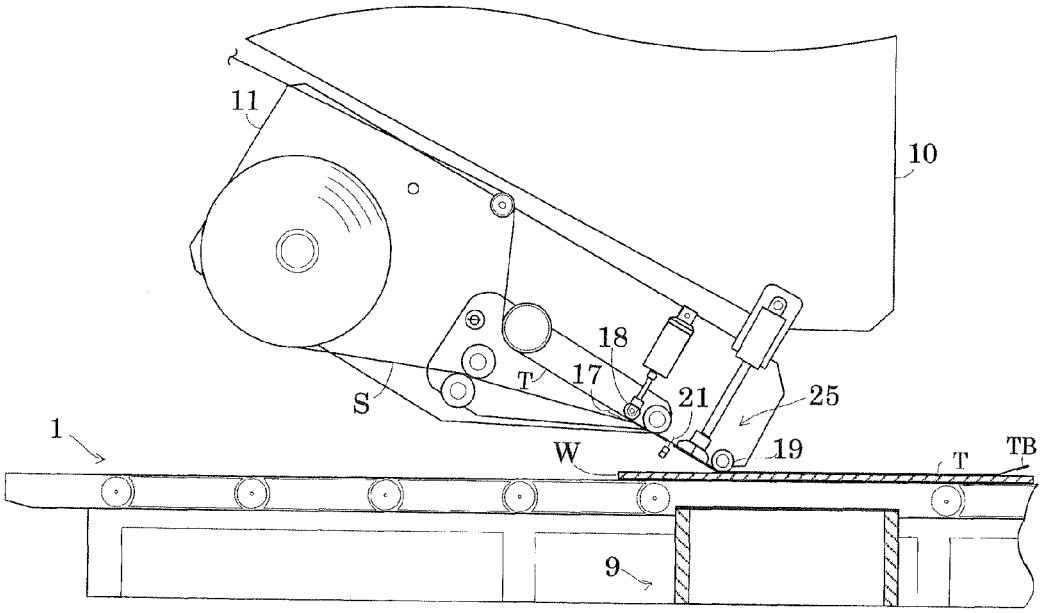

As shown in FIG. 8, the tape cutting mechanism 7 has a cutter holder. The cutter holder has a cutter blade 21 with an edge thereof being directed upward. The cutter blade 21 moves backward and forward from a standby position to a cutting position. Here the standby position is back of the apparatus from the tape cutting mechanism 7. In the cutting position, the adhesive tape T is to be cut. The cutter blade 21 also moves vertically in the operation position. Upon cutting of the adhesive tape T, an angle of the cutter blade 21 is adjusted such that the cutter blade 21 is set perpendicular to the adhesive tape T. For instance, the angle of the cutter blade 21 may be adjusted as follows. That is, an angle of the adhesive tape when pulled out by swinging the tape pulling mechanism 8 mentioned later is measured from a swinging angle of the tape pulling mechanism 8. Thereafter, a rotation angle of a pulse motor coupled to the cutter holder is controlled using the measured swinging angle of the tape pulling mechanism 8.

Now referring again to FIG. 1, the tape pulling mechanism 8 has a holder 25 at an end of a cylinder 24. The cylinder 24 is pivotally supported on the wall 10 via a bracket 23 and pivotable about an axis X3.

Figure 3:
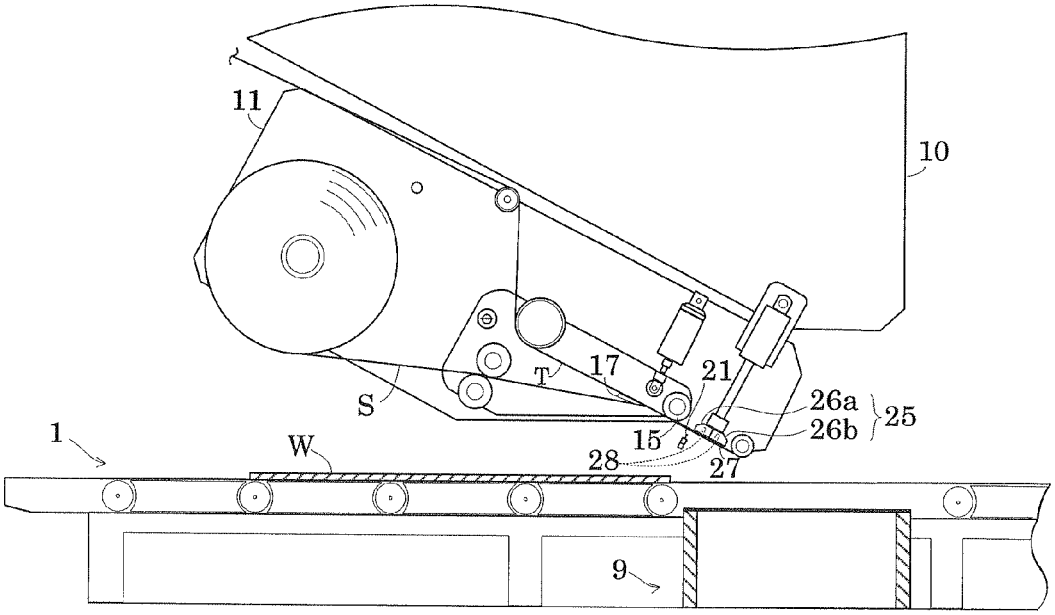
Figure 5:
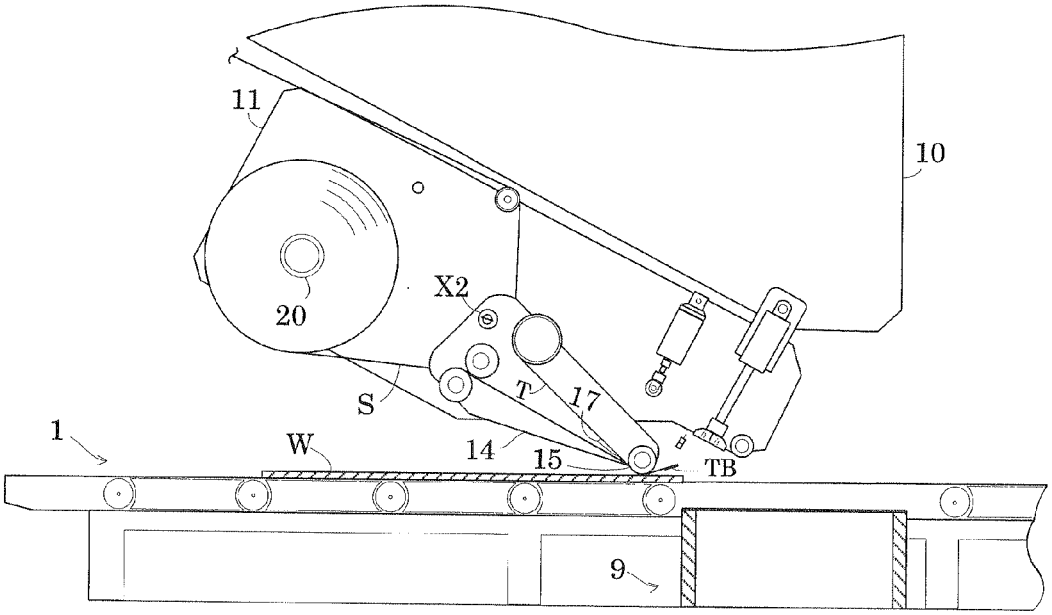

As shown in FIG. 3, the holder 25 has a pair of hold blocks 26*a* and 26*b* that are pivotally supported at the proximal end thereof. Each of the hold blocks 26*a* and 26*b* has a holding surface 27 with a suction hole 28 formed therein. The suction hole is in communication with a suction device. Specifically, the holding surface 27 sucks a non-adhesive surface of the adhesive tape T fed out from the edge member 17. The hold block 26*b* pivots. Consequently, the holding surfaces of the hold blocks 26*a* and 26*b* unite with each other. That is, the adhesive tape T folds back inwardly, as shown in FIG. 5, to form a tab TB with adhesive layers joined to each other. The holder 25 pulls out the adhesive tape T by holding the tab TB.

The tape collecting section 9 serving as a collecting box is provided below an opening of the tape transport mechanism 1 that is open forward of the tape joining portion.

A controller 30 operates so as to control each of the components en bloc. Moreover, the controller 30 controls each mechanism so as to satisfy requirements for cutting the joint P in the adhesive tape T. The requirements are determined using detected results of the joint detector 3 and the detector 4 with a computing unit 31 provided in the controller 30. Detailed control will be mentioned later by explanation of operations.

Next, description will be made of a basic operation of the foregoing adhesive tape joining apparatus to join an adhesive tape T to a building panel W with referring to FIGS. 2 to 8.

Figure 2:
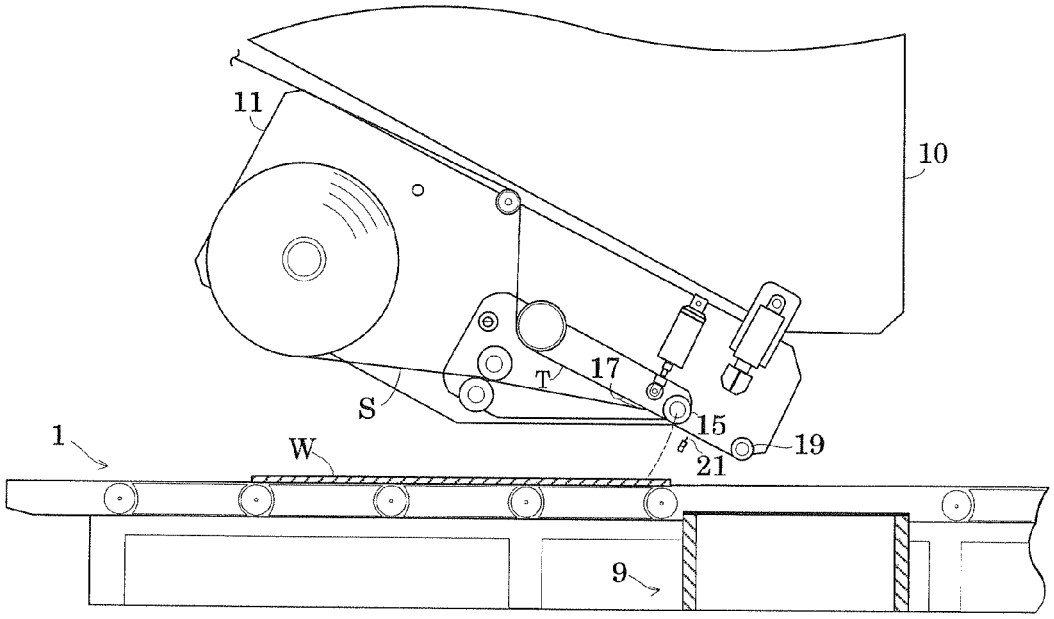
FIGS. 2 to 10 show basic operations of joining an adhesive tape according to Embodiment 1.

A sensor detects the building panel W transported by the tape transport mechanism 1. The tape transport mechanism 1 once stops in a joining position as shown in FIG. 2.

The tape pulling mechanism 8 operates as it stops transporting of the building panel W. The tape pulling mechanism 8 moves the holder 25 downward between first and second rollers 15 and 19, and opens the hold blocks 26*a* and 26*b*. Here, the hold blocks 26*a* and 26*b* are opened such that the holding surfaces 27 may be approximately flat.

A front end of the adhesive tape T is fed below the hold blocks 26*a* and 26*b* that are open to a straight angle with the holding surfaces 27 directed downward while the edge member 17 separates the separator S. Here, as shown in FIG. 3, the suction device operates to suction-hold the front end of the adhesive tape T with the holding surfaces 27.

Figure 4:
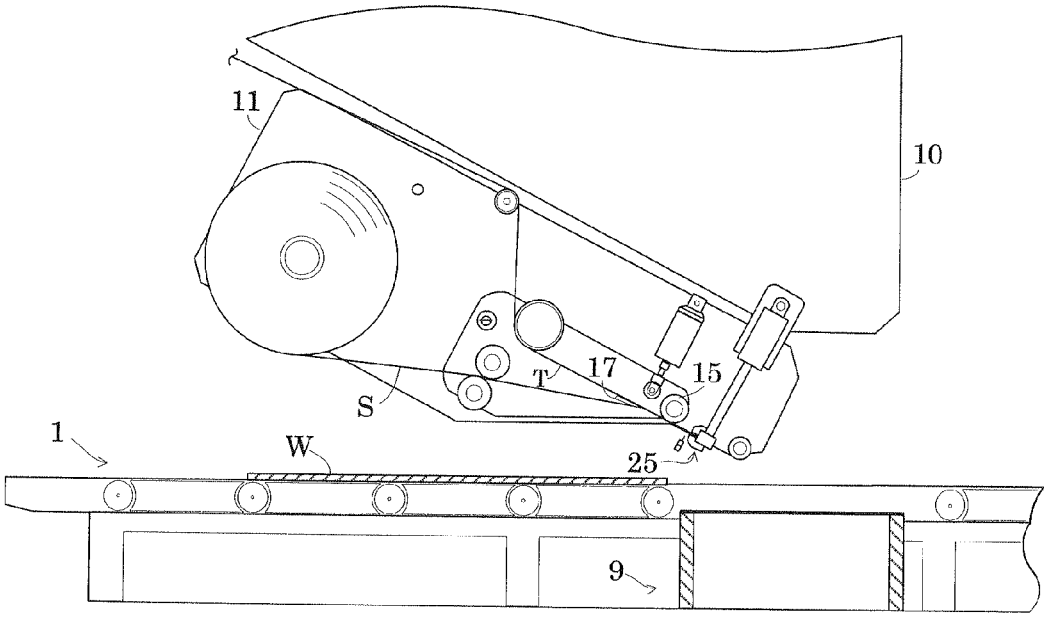

As shown in FIG. 4, upon completion of suction-holding the front end of the adhesive tape T, the hold block 26*b* pivots about the axial center to unite the holding surface 27 of the hold block 26*b* with that of the hold block 26*a*. Here, the front end of the adhesive tape T folds back inwardly by the hold block 26*b* to join the adhesive layers to each other. Consequently, the tab TB is formed as shown in FIG. 5.

The hold blocks 26*a* and 26*b* are opened after formation of the tab TB to release holding of the tab TB. Thereafter, the bracket 14 swings downward. Here, the front end of the adhesive tape T with the separator S separated therefrom by the edge member 17 is located below the first joining roller 15. That is, the joining roller 15 moves downward to press the adhesive tape T against the joining portion of the building panel W, thereby completing pressing of the front end of the adhesive tape T.

Figure 6:
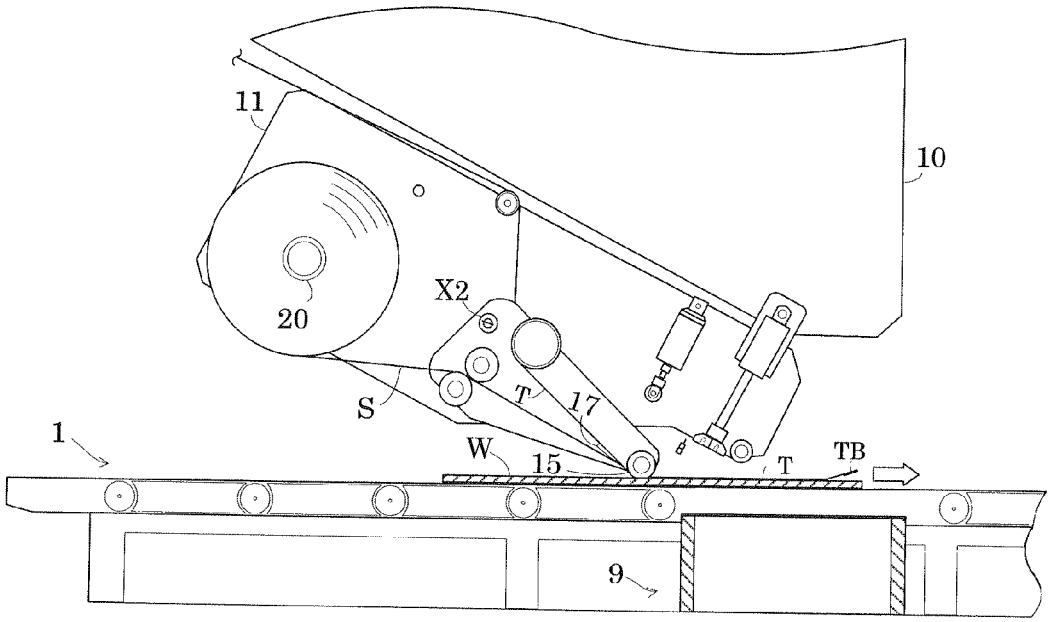
Figure 7:
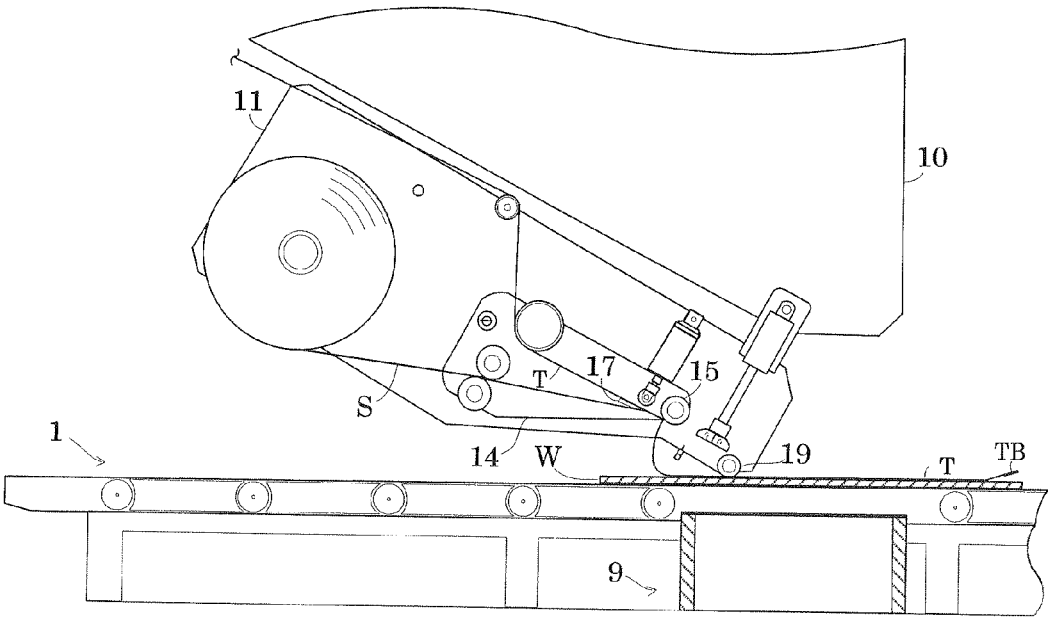

As shown in FIG. 6, the tape transport mechanism 1 operates to transport the building panel W in a transport direction. With this operation, the first joining roller 15 rolls while applying suitable pressure to the adhesive tape T.

When reaching to a terminal position of the joining portion, the first joining roller 15 stops transportation of the building panel W. With stopping of the transportation, the bracket 14 swings upward into a predetermined level thereof to release pressing of the first joining roller 15 against the adhesive tape T. Simultaneously, the bracket 11 swings downward such that the second joining roller 19 presses against the joining portion of the adhesive tape T.

The pressure roller 18 moves downward while the bracket 14 moves upward to hold the adhesive tape T with the tip end of the edge member 17. In this state, the building panel W slightly moves downstream to apply tension to the adhesive tape T.

As shown in FIG. 8, the holder 25 moves downward to a position of the adhesive tape where tension is applied between the tip end of the edge member 17 and the second roller 19. Thereafter, the holder 25 suction-holds the hold surfaces 27 of the hold blocks 26*a* and 26*b* that are in an open state.

In this state, the cutter blade 21 moves into a cutting position below the adhesive tape T. The cutter blade 21 moves upward in the cutting position to pierce through the adhesive tape T for cutting. Upon completion of cutting the adhesive tape T, the cutter blade 21 moves downward to returns to its original standby position.

Figure 9:
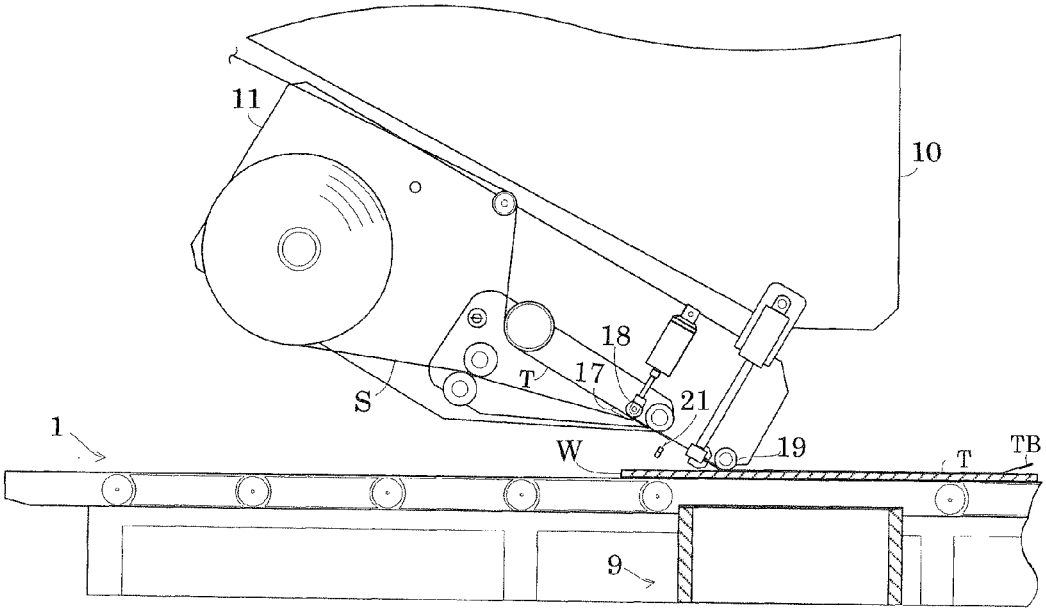
Figure 10:
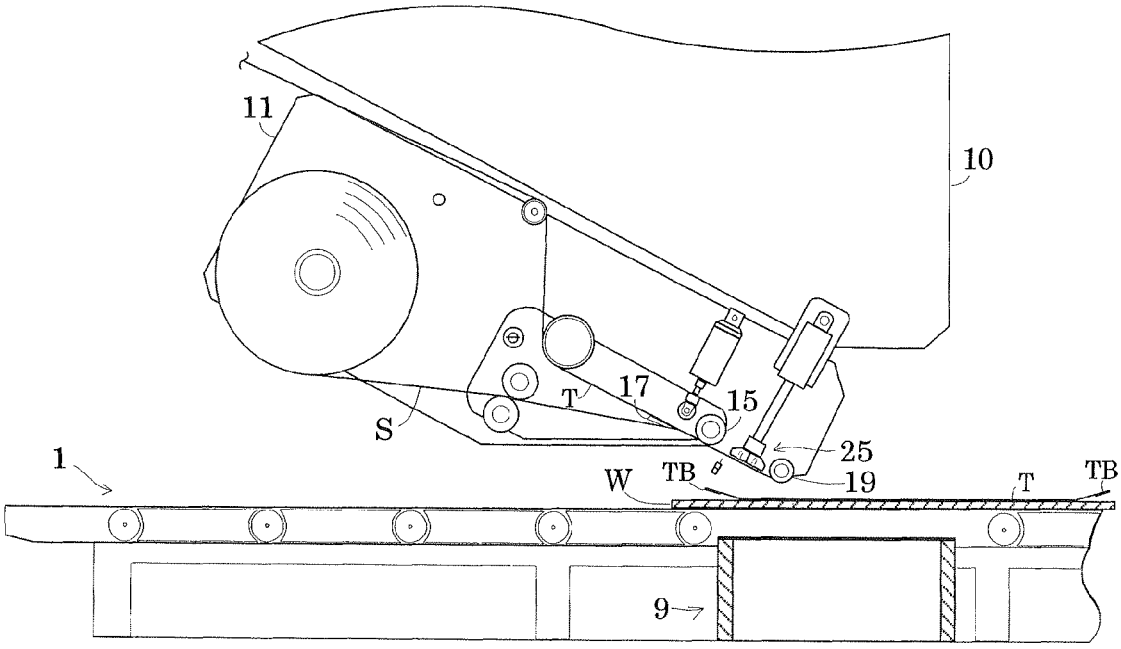

As shown in FIG. 9, the hold block 26*a* that suction-holds the rear end of the adhesive tape T pivots to unite the holding surfaces 27 of the hold blocks 26*a* and 26*b*. Here, the hold block 26*a* folds back the rear end of the adhesive tape T inwardly to adhere both of the adhesive layers. Consequently, the tab TB shown in FIG. 10 may be formed.

Upon completion of forming the tab TB, the hold blocks 26*a* and 26*b* are opened to release holding of the tab TB. In addition, the second joining roller 19 swings upward to return to its standby position, and only the building panel W is transported downstream, as shown in FIG. 2.

As mentioned above, a basic operation of joining the adhesive tape with the tab TB formed therein to the building panel W is completed. Subsequently, the same process as above is to be repeated.

Next, description will be given to an operation where the joint detector 3 detects the joint P in the adhesive tape T.

When detecting the joint P during repeating of the basic operation of joining the adhesive tape as above, the joint detector 3 transmits detection signals to the controller 30 that are detected from initiating to terminating of detecting the joint P.

The controller 30 controls the detector 4 to initiates detection of a feeding length of the adhesive tape T, and controls the computing unit 31 to perform a next computing process.

The computing unit 31 determines an allowable length of the adhesive tape T capable of being joined from the joining portion to the joint P, based on a length of the transportation path and a unit length of the adhesive tape T. Here, the length of the transportation path is determined in advance from the joint detector 3 to the joining portion. The unit length is a length of the adhesive tape T determined in advance that is joined to the joining portion of the building panel W. In addition, the computing unit 31 determines a removal length of the adhesive tape T. The removal length is from the terminal end of the allowable length to a cutting position of the adhesive tape T that is several millimeters forward from the terminal end of the joint P.

The controller 30 controls a basic joining process of the adhesive tape T to be performed until the detector 4 detects the feeding length of the adhesive tape T corresponding to the allowable length.

When the detector 4 detects the feeding length, the controller 30 stops the tape transport mechanism 1. Simultaneously, the cylinder 24 operates to move the holder 25 downward to a given level. The front end of the adhesive tape T is fed out below the hold blocks 26*a* and 26*b* that are open at a straight angle while separating the separator S with the edge member 17.

The controller 30 stops feeding of the adhesive tape T upon reaching of the front end of the adhesive tape T to a predetermined position below the hold blocks 26*a* and 26*b*. Thereafter, as shown in FIG. 3, the controller 30 controls a non-adhesive surface at front end of the adhesive tape to be suction-held on the holding surfaces 27.

Next, as shown in FIG. 4, the hold block 26*b* pivots to unit the holding surfaces of the hold blocks 26*a* and 26*b*. Here, the hold block 26*b* folds back the forward end of the adhesive tape T inwardly to adhere both of the adhesive layers. Consequently, the tab TB may be formed.

Figure 11:
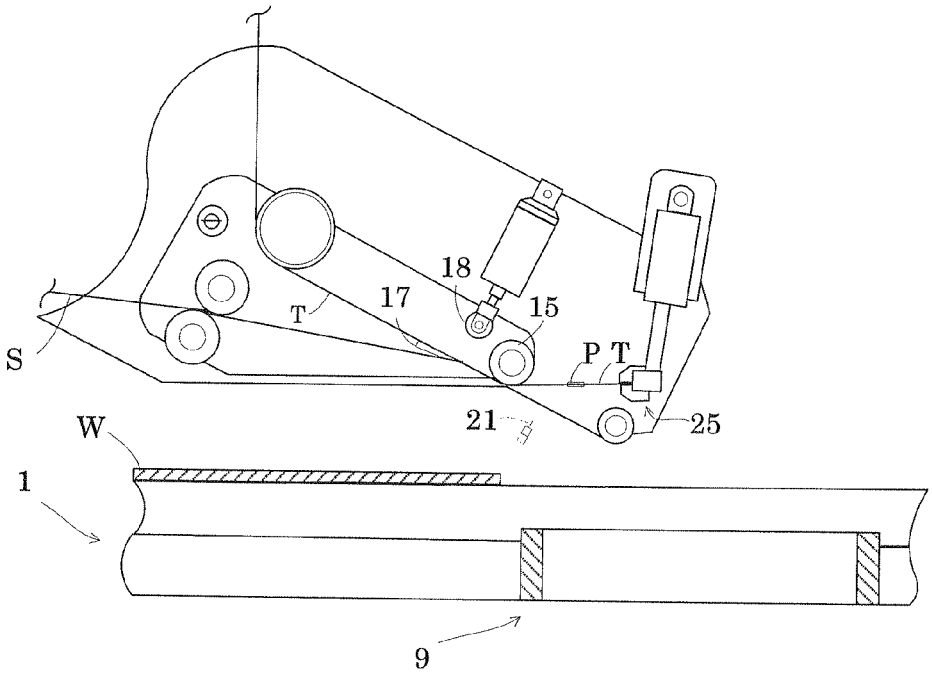
FIGS. 11 to 15 show operations of removing a joint according to Embodiment 1.

As shown in FIG. 11, the holder 25 swings upward in a tape feeding direction while holding the tab TB. Here, the adhesive tape T is pulled out by a removal length including the joint P. Simultaneously, the distance and level of swinging the holder 25 is controlled such that the second joining roller 19 deviates from a swinging track and the cut adhesive tape T does not come into contact with the other elements such as the second joining roller 19 and the building panel W due to hanging down thereof.

Figure 12:
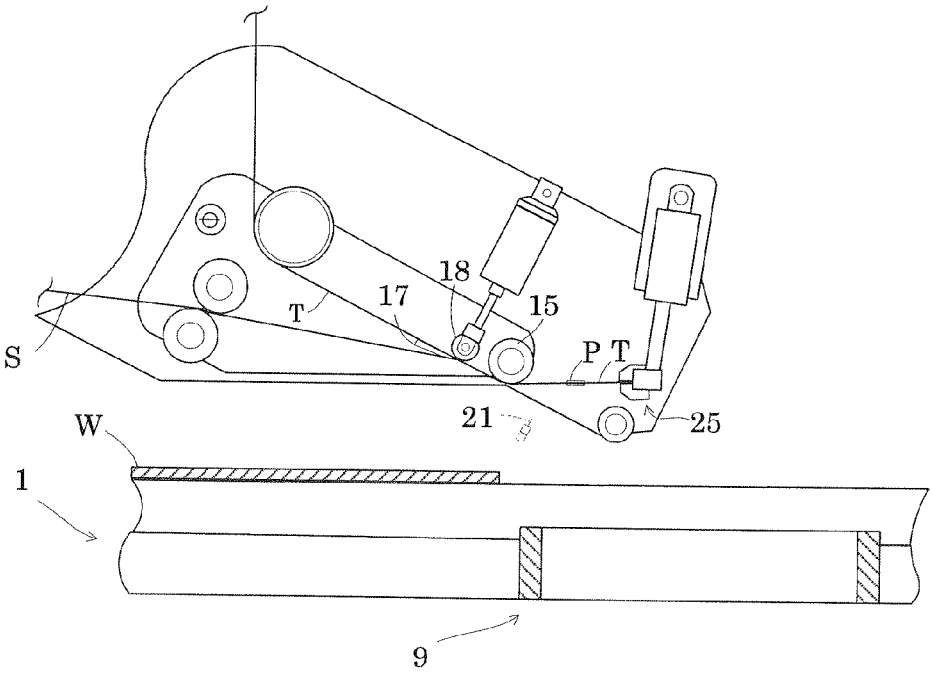

Upon completion of pulling out the adhesive tape by a removal length, the pressure roller 18 moves downward to hold the adhesive tape T with the tip end of the edge member 17, as shown in FIG. 12.

Figure 13:
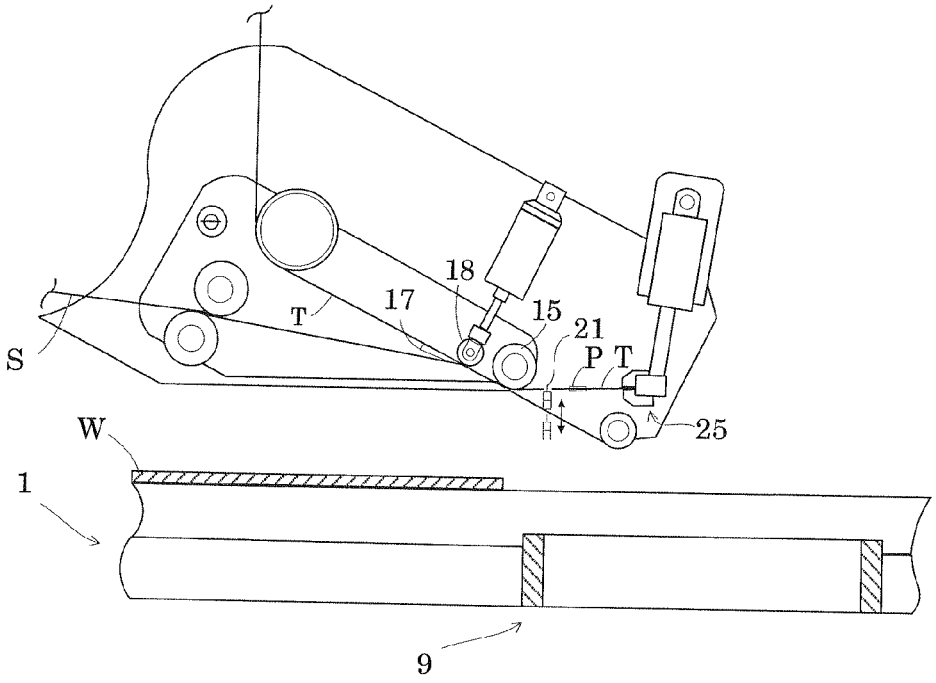

Tension is applied to the adhesive tape T using the tip end of the edge member 17 and the holder 25, and the cutter blade 21 moves to a cutting position below the adhesive tape T. As shown in FIG. 13, an angle of the cutter blade 21 is adjusted so as to be perpendicular to the adhesive tape T, and thereafter the cutter blade 21 moves upward to cut the adhesive tape T. Upon completion of cutting the adhesive tape T, the cutter blade 21 returns to its standby position.

Figure 14:
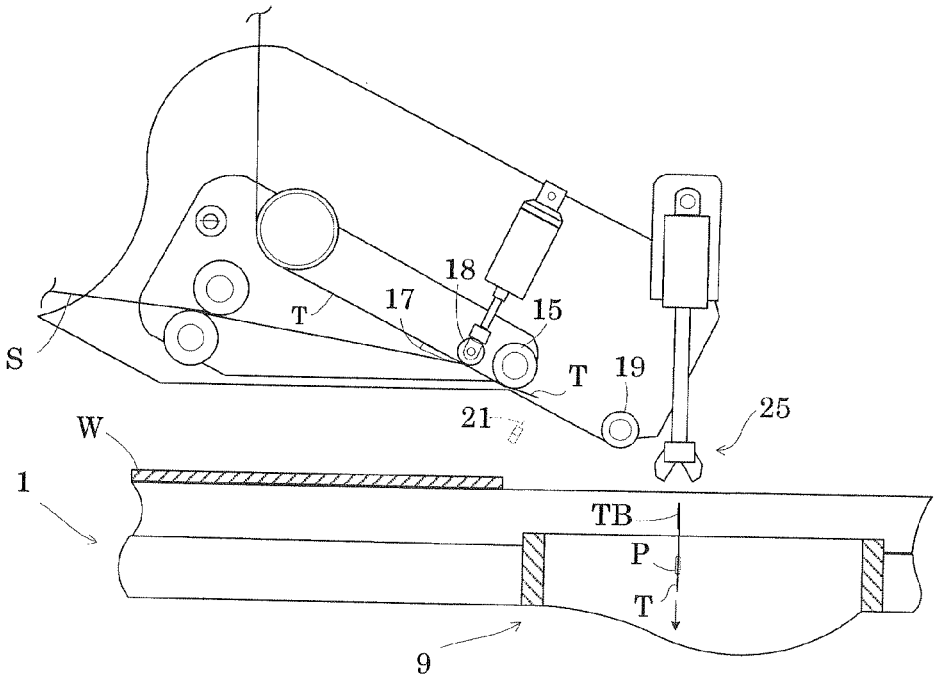

The adhesive tape T is cut, and simultaneously, the holder 25 releases its holding above the opening of the tape transport mechanism 1 with its swing movement and level being under control, and thereafter the adhesive tape T to be removed is collected into the tape collection section 9, as shown in FIG. 14. That is, the adhesive tape T is disposed of through the track where the cut adhesive tape T does not come into contact with the surrounding element such as the second joining roller 19. After disposal of the adhesive tape T, every mechanism returns to its initial position to continuously perform a subsequent joining process of the adhesive tape T.

As mentioned above, removal of the joint P in the adhesive tape T and joining of the adhesive tape T to the building panel W after the removal are completed. After this process, a basic joining process is to be repeated.

The foregoing adhesive tape joining apparatus may avoid joining of the joint P of the adhesive tape T to the building panel W as an adherend. Moreover, the removal length including the joint P may be minimized with the unit length of the joining portion of the adhesive tape T being maintained. Consequently, a disposal amount of the adhesive tape T may also be reduced.

Embodiment 2

Embodiment 2 differs from Embodiment 1 in configuration of the tape pulling mechanism 8 and tape collecting section 9. Specifically, an adhesive tape joining apparatus in Embodiment 2 has one mechanism with tape pulling and collecting functions. Like reference numerals are used to identify like elements that are the same as in Embodiment 1 and will not particularly be described. Only the element with different configuration from that in Embodiment 1 will be described in detail.

Figure 15:
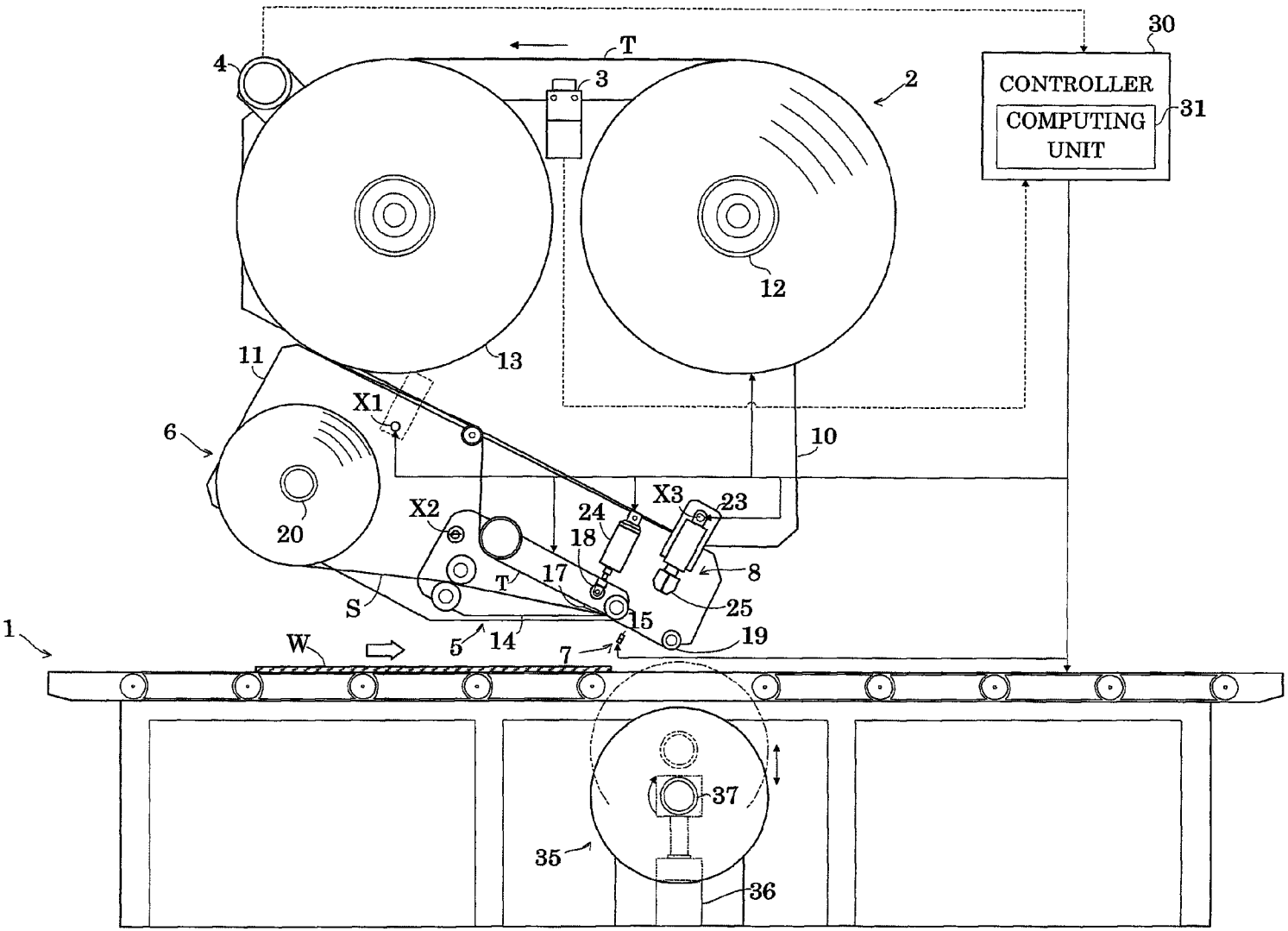

As shown in FIG. 15, the adhesive tape joining apparatus in Embodiment 2 has a tape winding mechanism 35 that moves upward and downward from a tape collecting position to a retracting position therebelow. Here, the tape collecting position is over an opening of the tape transport mechanism 1 that is open forward of the tape joining portion. The tape winding mechanism 35 moves a winding drum 37 vertically with an actuator 36.

Figure 16:
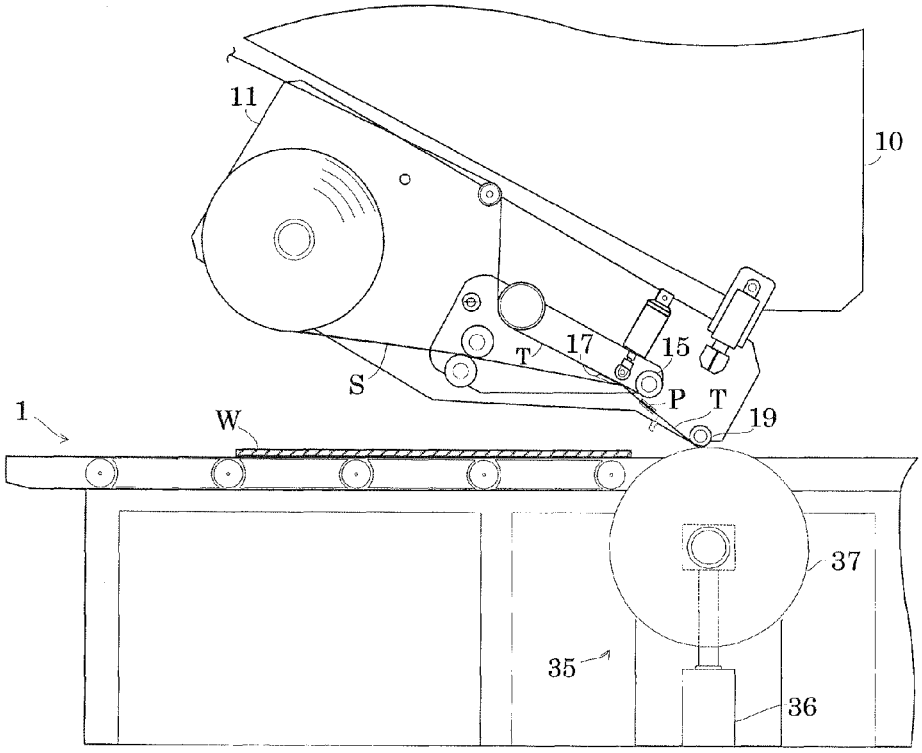
FIG. 16 is a front view of an adhesive tape joining apparatus according to Embodiment 2.
Figure 17:
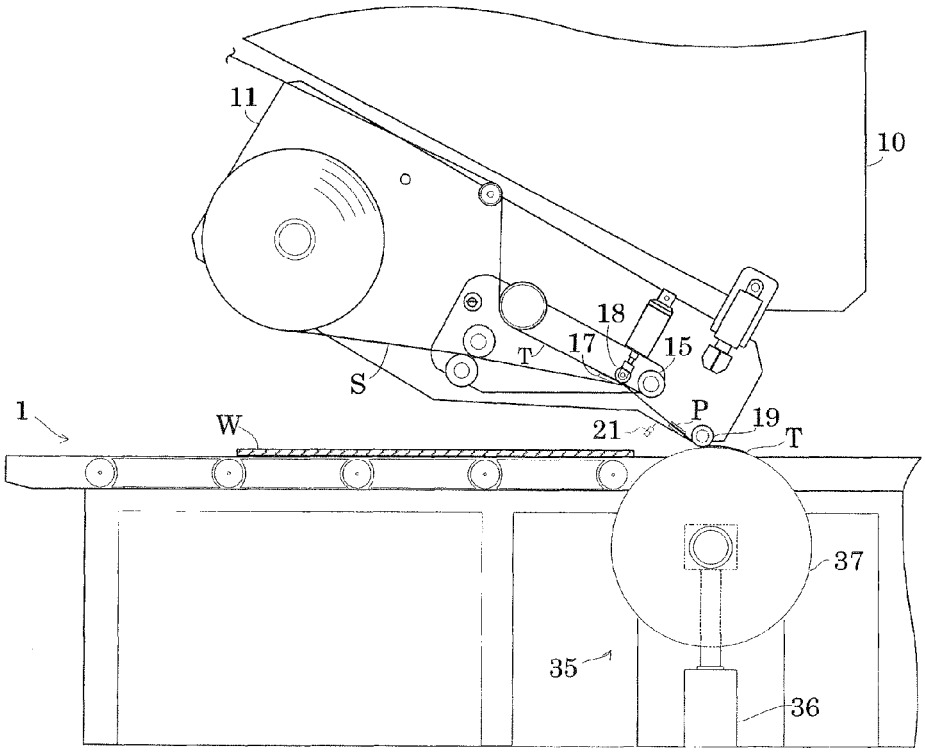
FIGS. 17 and 18 show operations of removing a joint according to Embodiment 2.
Figure 18:
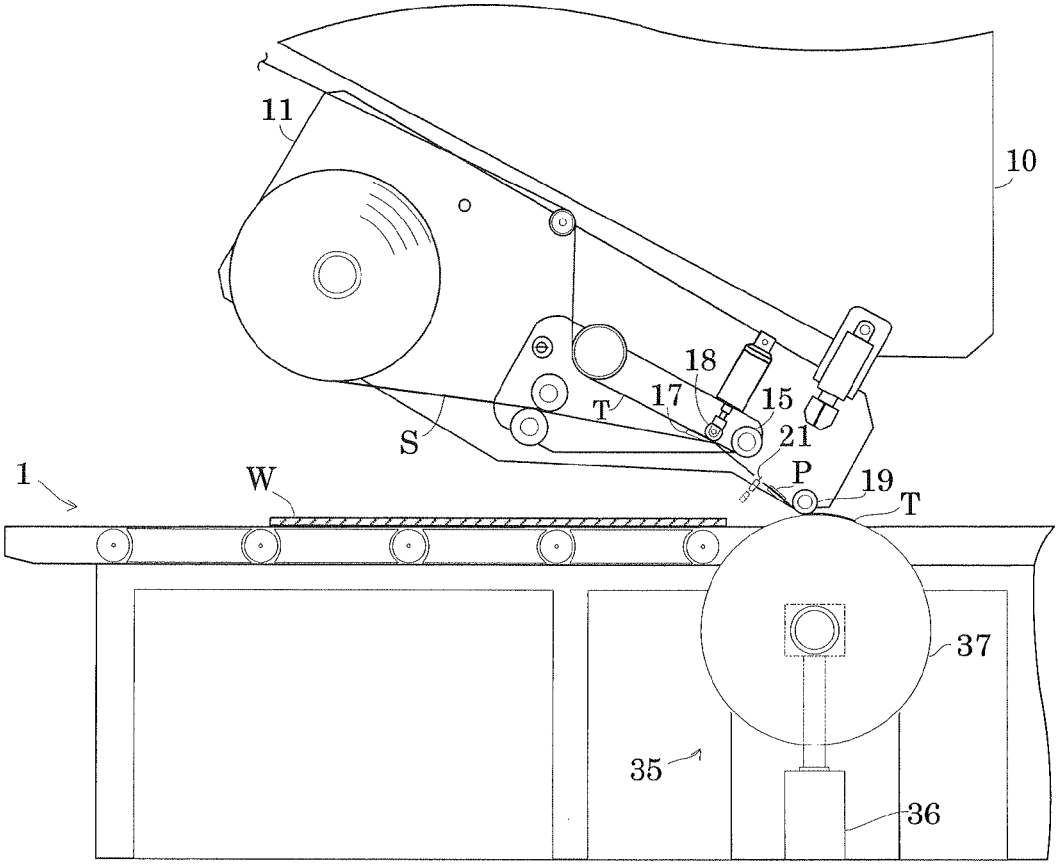

Next, with reference to FIGS. 16 to 18, description will be given to an operation of the adhesive tape joining apparatus in the exemplary embodiment to remove the adhesive tape T including the joint P.

A computing unit 31 determines an allowable length and a unit length of the adhesive tape T. A controller 30 controls a basic joining process of the adhesive tape T to be performed until the detector 4 detects the feeding length of the adhesive tape T corresponding to the allowable length.

When the detector 4 detects the allowable length of the adhesive tape T, the controller 30 stops the tape transport mechanism 1. Simultaneously, as shown in FIG. 16, the controller 30 operates the actuator 36 to moves the winding drum 37 upward to a winding position.

The controller 30 controls the front end of the adhesive tape T to be fed out into the winding position while separating the separator S with the edge member 17.

The front end of the adhesive tape T reaches to the winding position, the second joining roller 19 moves downward to press the front end against the winding drum 37 for joining. Thereafter, the adhesive tape T including the joint P is pulled out by the removal length from the edge member 17 while being wound. Here, the controller 30 controls a winding speed of the adhesive tape T by the tape winding mechanism 35 so as to correspond to a supplying speed of the adhesive tape T from the tape supplying mechanism 2.

Upon completion of pulling out the adhesive tape T, the winding drum 37 stops rotating. Next, as shown in FIG. 17, the pressure roller 18 moves downward to hold the adhesive tape T with the tip end of the edge member 17. Simultaneously, the cylinder 24 operates to move the holder 25 downward to a given level and to suction-hold the adhesive tape T with the holding surfaces 27. That is, tension is applied to the adhesive tape T with the opposite ends of the cut portion thereof being held.

Upon completion of applying tension to the cut portion of the adhesive tape T, the cutter blade 21 moves to a cutting position below the adhesive tape T. When reaching to the cutting position, the cutter blade 21 moves upward to cut the adhesive tape T. Upon completion of cutting the adhesive tape T, the cutter blade 21 moves downward to return to its standby position.

Upon completion of cutting the adhesive tape T, the winding drum 37 rotates to wind up and collect the cut-out adhesive tape T while pressing with the second joining roller 19.

Upon completion of collecting the cut-out adhesive tape T, the second joining roller 19 swings upward and the winding drum 37 retracts.

As mentioned above, removal of the joint P in the adhesive tape T is completed. After this process, a basic joining process is to be repeated.

According to the adhesive tape joining apparatus in Embodiment 2, the mechanism to collect the adhesive tape T may readily be adjusted and controlled as compared with the apparatus in Embodiment 1.

This invention is not limited to the foregoing embodiment, but may be modified as follows.

In the foregoing exemplary embodiments, the adhesive tape T is joined while moving the building panel W. In addition, the adhesive tape T may be joined to an adherend while moving the adhesive tape joining apparatus.

In the foregoing exemplary embodiments, the adhesive tape has at its opposite ends the tab TB. In addition, the adhesive tape T with no tab TB formed therein may be joined to the building panel W.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of joining an adhesive tape to an adherend, comprising:

a detecting step;

a removing step removing the joint in accordance with detected results; and a joining step joining the adhesive tape with the joint removed therefrom to the adherend, the detecting step including:

detecting a joint in the adhesive tape directly by a detector during supplying to the adherend the adhesive tape of a long length in which adhesive tapes of a predetermined length are connected to one another;

transmitting detection signals to a controller that are detected from initiating to terminating of detecting the joint, detecting a length of the joint by the controller, determining an allowable length of the adhesive tape capable of being joined from a joining portion to the joint in accordance with the length of the joint, a length of a transportation path determined in advance corresponding to a distance from a detecting position to a tape joining position of the adhesive tape, and a unit length of the adhesive tape joined to the adherend; and determining a removal length including the joint backward from the allowable length.

2. The method of joining the adhesive tape according to claim 1, wherein the joining step comprises joining of the adhesive tape except the removal portion of the adhesive tape including the joint to the adherend in accordance with the detected results obtained in the detecting step.

3. The method of joining the adhesive tape according to claim 1, wherein the joining step comprises joining the adhesive tape to the adherend after pulling out the removal portion of the adhesive tape at the joining position and cutting to remove thereof.

4. The method of joining the adhesive tape according to claim 1, wherein the joining step comprises joining the adhesive tape to the adherend after pulling out the removal portion of the adhesive tape at the joining position and winding to collect thereof.

5. The method of joining the adhesive tape according to claim 4, further comprising the steps of:

joining a front end of the adhesive tape to be removed to a winding drum that moves to the tape joining position;

winding up the adhesive tape by a predetermined length; and cutting the adhesive tape.

* * * * *